United States Patent [19]

Baird, Jr. et al.

[11] 4,127,470

[45] Nov. 28, 1978

[54] HYDROCONVERSION WITH GROUP IA, IIA METAL COMPOUNDS

[75] Inventors: William C. Baird, Jr.; Roby Bearden, Jr.; Thomas H. Ledford, all of Baton Rouge, La.

[73] Assignee: Exxon Research & Engineering Company, Florham Park, N.J.

[21] Appl. No.: 820,859

[22] Filed: Aug. 1, 1977

[51] Int. Cl.[2] ..... C10G 13/04; B01J 27/04

[52] U.S. Cl. ..... 208/58; 208/89; 208/108; 208/112; 208/212; 208/213; 208/226; 252/475

[58] Field of Search ..... 208/58, 108, 212

[56] References Cited

U.S. PATENT DOCUMENTS

| | | | |
|---|---|---|---|
| 1,729,943 | 10/1929 | Hofsass | 260/667 |
| 1,845,439 | 2/1932 | Pier et al. | 208/112 |
| 1,968,208 | 7/1934 | Hugel et al. | 208/108 |
| 3,788,978 | 1/1974 | Bearden et al. | 208/208 M |
| 3,976,559 | 8/1976 | Bearden et al. | 208/89 |
| 4,003,823 | 1/1977 | Baird et al. | 208/108 |
| 4,003,824 | 1/1977 | Baird et al. | 208/108 |
| 4,007,111 | 2/1977 | Baird | 208/108 |
| 4,017,381 | 4/1977 | Baird et al. | 208/108 |
| 4,076,613 | 2/1978 | Bearden | 208/108 |

*Primary Examiner*—Delbert E. Gantz
*Assistant Examiner*—G. E. Schmitkons
*Attorney, Agent, or Firm*—Marthe L. Gibbons

[57] ABSTRACT

Processes for the treating of sulfur-containing petroleum oil feedstocks employing alkali metal compounds, alkaline earth metal compounds, and mixtures thereof are disclosed. Specifically, processes for hydrotreating feedstocks which have been previously partially desulfurized using conventional hydrodesulfurization catalysts by contacting such feedstocks with alkali metal compounds, alkaline earth metal compounds, and mixtures thereof, are disclosed. Preferably, the products of such a treatment are employed as feeds for catalytic cracking processes. In addition, processes for the combined hydrotreating and hydroconversion of various sulfur-containing petroleum oil feeds are disclosed, employing at least two hydroconversion agents selected from the group consisting of the alkali metal compounds and alkaline earth metal compounds, in the presence of added hydrogen, and at elevated temperatures. The reaction products formed thereby include a substantially desulfurized and demetallized, as well as a significantly upgraded petroleum product. The latter is demonstrated by a reduced Conradson carbon content and an increased API gravity.

7 Claims, 1 Drawing Figure

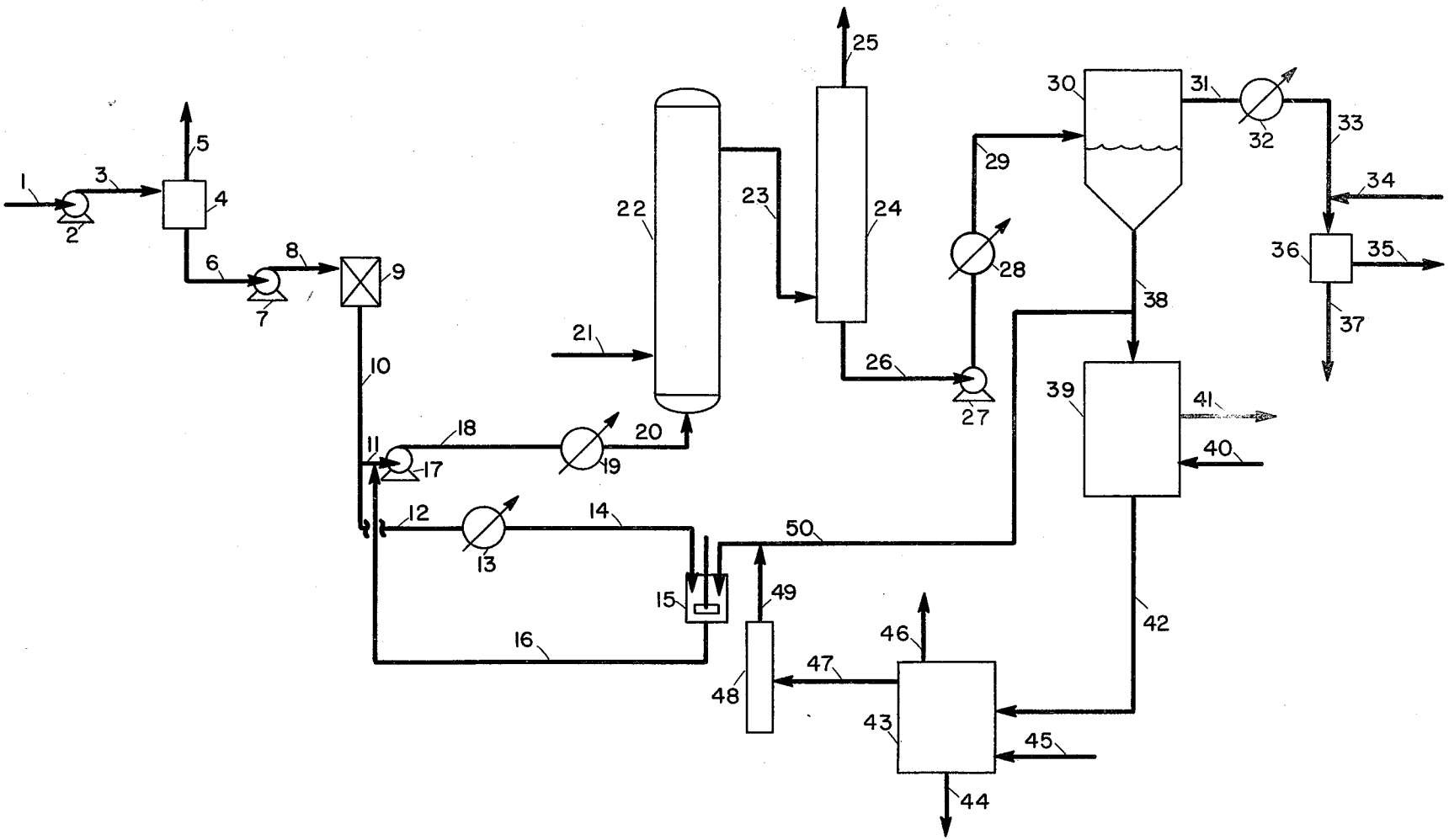
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50

HYDROCONVERSION WITH GROUP IA, IIA METAL COMPOUNDS

FIELD OF THE INVENTION

This invention relates to the hydrotreating of sulfur-containing petroleum oil feedstocks. More specifically, the present invention relates to the hydrotreating of partially desulfurized petroleum oil feedstocks in order to produce catalytic cracking feeds. Still more specifically, the present invention relates to the combined hydrotreating and hydroconversion of sulfur-containing petroleum oil feedstocks employing alkali and alkaline earth metal compounds. Still more particularly, the present invention relates to the preparation of reduced sulfur content petroleum oil products obtained by contacting sulfur-containing feedstocks with alkali and alkaline earth metal compounds in the presence of added hydrogen and at elevated temperatures.

BACKGROUND OF THE INVENTION

The current trend in refinery crude slates is for the utilization of increasingly heavy and "dirty" feedstocks, including large amounts of sulfur, nitrogen, metals, etc. In addition, an increasing proportion of these crude oils is present as residual fuels, and the principal outlet for these fuels is as low sulfur fuel oils subsequent to catalytic desulfurization. Because of the increasing problems of air pollution, particularly with regard to sulfur oxide emissions, increasing concern among refiners has arisen with respect to the utilization of these feedstocks. Consequently, the development of efficient and economical means for sulfur removal from these heavy sulfur-bearing oils has become a primary research goal in this industry. While the most practical desulfurization process at this time is the catalytic hydrogenation referred to above, these processes generally produce a product which, while having reduced sulfur and nitrogen content, includes sufficient feedstock impurities to render further processing, particularly by way of catalytic cracking, increasingly difficult if not impossible. The use of catalytic cracking, however, is today the principal gasoline manufacturing process in a modern refinery. Furthermore, the catalytic cracking catalysts which are generally employed are quite sensitive to these catalyst poisons, such as sulfur, etc., and additionally sulfur dioxide emissions must be dealt with upon regeneration of these deactivated catalysts. Also, the nitrogen compounds present in these feedstocks tend to neutralize the required catalyst acidity, and favor the lay-down of coke on the catalyst surface. Furthermore, Conradson carbon precursors generate surface coke, the excess formation of which upsets the heat balance of the catalytic cracking process. Finally, the metals present in these feedstocks, primarily nickel, further cause catalyst deactivation.

On the other hand, the catalytic hydrogenation process itself, while generally quite efficient in handling distillates, becomes much more complex and expensive, and considerably less efficient, as these feedstocks become increasingly heavy, e.g., whole or topped crudes and residua. Many of the same contaminants which render the hydrogenation products difficult to utilize in catalytic cracking processes thus have a similar effect on the hydrogenation catalyst itself. Furthermore, much of the sulfur contained in the higher molecular weight molecules in these feedstocks can only be broken down when operating under severe operating conditions. These same conditions, however, also tend to accelerate catalyst deactivation due to accelerated coke and metal deposition on the catalyst surfaces.

It has long been known that alkali and alkaline earth metals, as well as their corresponding hydrides, hydroxides, oxides, etc., exhibit desulfurization activity for residua. Even so, however, these compounds have been found to suffer from several distinct drawbacks, such as poor desulfurization efficiency, a tendency to produce oil insoluble sludges, the inability to upgrade feedstocks by demetallization, and the formation of salt-oil mixtures that are exceedingly difficult to resolve by conventional means. Furthermore, again, none of these materials has ever been employed to obtain the simultaneous desulfurization and substantial hydroconversion of the feedstocks being treated. In this regard, however, the assignee of the present application, Exxon Research and Engineering Company, has recently discovered that such simultaneous desulfurization and hydroconversion of these feedstocks can be obtained by utilizing various alkali and alkaline earth metal compounds under certain conditions. Thus, in Ser. No. 571,904, filed on Apr. 28, 1975 abandoned for CIP 733,085, the inventors of the present application discovered that alkaline earth metal hydrides and alkaline earth metal oxides can be employed for such purposes under increased hydrogen partial pressures. Furthermore, in Ser. No. 571,903, also filed on Apr. 28, 1975 now U.S. Pat. No. 4,076,613, the inventor, Roby Bearden, Jr. discloses the use of alkali metals for such combined desulfurization and hydroconversion, obtaining at least 50 weight percent sulfur reduction as well as a reduction of the 1050° F.+ fraction as well as a significant decrease in the Conradson carbon and an increased API gravity of the hydrogenated products. In addition, in U.S. Pat. No. 3,976,559 the inventors, Roby Bearden, Jr. and Glen R. Hamner, disclose a combined hydrodesulfurization and hydroconversion process including initial contact with a hydrodesulfurization catalyst which selectively avoids converting the asphaltene agglomerates in metal-containing compounds therein, and subsequent contact with an alkali metal for combined desulfurization and hydroconversion to lower boiling products. Finally, in U.S. Pat. No. 4,003,823 the inventors, William C. Baird, Jr. and Roby Bearden, Jr., disclosed the combined desulfurization and hydroconversion of heavy carbonaceous feeds by contacting with alkali metal hydroxides, at elevated temperatures, in the presence of added hydrogen.

Each of these processes, all of which are assigned to Exxon Research and Engineering Company, the assignee of the present invention, provides an excellent commercial possibility for the simultaneous hydroconversion and hydrodesulfurization of heavy sulfur-containing feedstocks.

It has now been found, in addition, that various alkali metal and alkaline earth metal compounds, and mixtures thereof, may be advantageously employed for the simultaneous desulfurization and hydroconversion of various sulfur-containing petroleum oil feedstocks which have been previously subjected to catalytic desulfurization in the general manner described above. It has also been discovered that various mixtures of alkali metal and alkaline earth metals and compounds thereof may be employed for the significant combined desulfurization and hydroconversion of various heavy sulfur-containing feedstocks.

SUMMARY OF THE INVENTION

In accordance with the present invention, it has now been discovered that a highly suitable catalytic cracking feedstock may be obtained by contacting a sulfur-containing petroleum oil feedstock with a hydrodesulfurization catalyst, in a reaction zone, at elevated temperatures between about 500° and 2,000° F., preferably 500° to 1,500° F., and in the presence of sufficient added hydrogen to produce a pressure of from about 500 to 2,500 psig, preferably 500 to 2,000 psig, so that a partially desulfurized product is produced, i.e. preferably having a sulfur content of less than about 1 wt.percent of sulfur, and subsequently contacting that partially desulfurized product, in a second reaction zone, with a compound selected from the group consisting of alkali metal compounds, and mixtures thereof. The reaction product produced as a result of this procedure comprises a highly desulfurized and upgraded petroleum oil, which represents an excellent candidate for further upgrading by way of catalytic cracking.

In another embodiment of the present invention a highly efficient desulfurization and hydroconversion process is provided, wherein sulfur-bearing petroleum oil feedstocks are contacted in a reaction zone, preferably in the liquid phase, with a hydroconversion agent including at least two compounds selected from the group consisting of the alkali metal compounds and alkaline earth metal compounds, in the presence of added hydrogen, and at elevated temperatures. It has thus been unexpectedly discovered that by employing combinations of these alkali metal and alkaline earth metal compounds synergistic results may be obtained, particularly where a combination of a moderately active one of these compounds and a relative inert or passive one of these compounds is employed. The reaction product produced as a result of the above process comprises a desulfurized, upgraded petroleum oil, and the recovered reagents may be recycled to the reaction zone without regeneration.

BRIEF DESCRIPTION OF THE DRAWING

The drawing is a schematic representation of a hydrotreating process in accordance with one embodiment of the present invention.

DETAILED DESCRIPTION

The process of this invention is generally applicable to any sulfur-bearing petroleum oil feedstock. Thus, while the process is applicable to distillates, it is particularly effective when utilized to treat heavy hydrocarbon fractions, e.g., those containing residual oils. Preferably, therefore, the process of this invention is utilized with the treatment of whole or topped crude oils and residua. Crude oils obtained from any area of the world, such as the Middle East, e.g., Safaniya, Arabian heavy, Iranian light, Kuwait, etc., the United States or Venezuelan, e.g., Laquinallis, Tijuana, Bachaquero, etc., as well as heavy gas oils, shale oils, heavy cat-cycle oils, tar sands or syncrude derived from tar sands, coal oils, bitumen derived from tar sands, coal, and asphaltenes, as well as other carbonaceous feeds may be treated by the process of this invention. Additionally, both atmospheric residuum (boiling above about 650° F.) and vacuum residuum (boiling above about 1050° F.) can be treated. Preferably, the feedstock is a sulfur-bearing heavy hydrocarbon oil having at least about 10 percent materials boiling above about 1050° F., more preferably at least about 25 percent of materials boiling above about 1050° F.

These feedstocks may be introduced directly into a contacting zone for either preliminary catalytic desulfurization or combined desulfurization and hydroconversion without pretreatment. It is desirable, however, to desalt the feedstock in order to prevent NaCl contamination of the alkali metal and/or alkaline earth metal products of the desulfurization reaction. Such desalting processes are well-known in the refining industry, and may be effected by the addition of small amounts of water to the feedstock to dissolve the salt followed by the use of electrical coalescers. The oil may then be dehydrated by conventional means.

The alkali metals which may be employed in the process of the present invention as alkali metal compounds generally include compounds of the metals of group IA of the Periodic Table. Specifically, these include lithium, sodium, potassium, rubidium, and cesium. The alkaline earth metals which may be employed in the process of the present invention as alkaline earth metal compounds generally incude compounds of the metals of Group IIA of the Periodic Table. These include beryllium, magnesium, calcium, strontium, and barium. Among the alkali metal compounds employed, it is preferred that compounds of sodium and potassium be utilized. Among the alkaline earth metal compounds employed, it is preferred that compounds of calcium, barium and magnesium be utilized.

The alkali metal compounds and/or alkaline earth metal compounds which may be employed in the process of the present invention generally include the oxides, hydroxides, sulfides, hydrosulfides, hydrides, amides, carbonates, carboxylates, alkoxides, and/or other suitable anions in combination with these alkali and alkaline earth metals.

The preferred alkali metal compounds for use in the present invention include sodium hydroxide, sodium sulfide, sodium oxide, sodium hydrosulfide, sodamide, sodium hydride, sodium carbonate, potassium hydroxide, potassium sulfide, potassium oxide, potassium hydrosulfide, potassium amide, potassium hydride, potassium carbonate, potassium methoxide, cesium hydroxide, cesium oxide, cesium hydrosulfide, cesium carbonate, and cesium sulfide. The most preferred alkali metal compounds include sodium hydroxide, sodium oxide, sodium sulfide, sodium hydrosulfide, potassium hydroxide, potassium sulfide, potassium oxide, and potassium hydrosulfide.

The preferred alkaline earth metal compounds for use in the present invention include calcium oxide, calcium sulfide, calcium hydroxide, calcium carbonate, barium oxide, barium hydroxide, barium carbonate, magnesium oxide, magnesium hydroxide, and magnesium carbonate. The most preferred alkaline earth metal compound is calcium oxide.

In one preferred embodiment of the present invention, wherein the petroleum oil feed is preferably directly subjected to combined hydrodesulfurization and hydroconversion, at least two components selected from the alkali metal compounds and alkaline earth metal compounds are employed. In this embodiment, the proportions of each of the selected components is not deemed critical and may vary within a large range. It is preferred, however, that the combination include at least one component which is relatively active for the combined desulfurization and hydroconversion of these feedstocks and at least one component which is relatively inactive for such purposes, but which nevertheless acts to provide a combination which is more active than either component.

Of the alkali metal compounds listed above, the following constitute relatively active hydroconversion reagents when used alone; sodium, potassium, and cesium oxide; sodium and potassium hydride; sodamide; potassium and cesium hydroxide; potassium and cesium sulfide; potassium amide; and potassium methoxide. Of the alkaline earth metal compounds listed above, barium oxide is a relatively active reagent. The relatively inactive alkali metal compounds, again on a comparative basis, include sodium, potassium and cesium carbonate; sodium and potassium hydrosulfide; sodium hydroxide; and sodium sulfide. The relatively inactive alkaline earth metal compounds include calcium and barium hydroxide; calcium and barium carbonate; calcium oxide; and calcium sulfide.

As stated above, however, various combinations of these compounds have been found to be quite superior hydroconversion and desulfurization agents as compared to some of these individual compounds. Representative of such combinations which lead to improved performance in this regard include the following;

(i) Combinations of a relatively active alkali metal compound with another relatively active alkali metal compound;

(ii) Combinations of a relatively active alkali metal compound with a relatively inactive alkali metal compound;

(iii) Combinations of a relatively active alkali metal compound with a relatively active alkaline earth metal compound;

(iv) Combinations of a relatively active alkali metal compound with a relatively inactive alkaline earth metal compound; and (v) Combinations of a relatively inactive alkali metal compound with a relatively inactive alkaline earth metal compound.

Preferred combinations of these various compounds thus include the following; sodium hydroxide/calcium oxide; potassium hydroxide/calcium oxide; sodium carbonate/calcium oxide; potassium carbonate/calcium oxide; sodium hydroxide/potassium hydroxide/calcium oxide; potassium hydroxide/barium oxide; potassium hydroxide/calcium hydroxide; potassium sulfide/-sodium sulfide; potassium hydroxide/sodium sulfide; potassium hydrosulfide/calcium oxide; cesium hydroxide/sodium sulfide; potassium hydrosulfide/sodium sulfide; potassium methoxide/calcium oxide; potassium sulfide/calcium oxide; potassium sulfide/sodium hydroxide; potassium sulfide/calcium sulfide; cesium sulfide/calcium carbonate; sodium sulfide/calcium oxide; sodium hydrosulfide/calcium oxide; sodium hydroxide/sodium sulfide; potassium hydrosulfide/sodium hydroxide; and sodium hydrosulfide/potassium hydroxide. Most preferred among the various combinations usable within the scope of the present invention include the following; sodium hydroxide/calcium oxide; potassium hydroxide/calcium oxide; potassium sulfide/-sodium sulfide; potassium hydroxide/sodium sulfide; potassium hydrosulfide/calcium oxide; potassium hydrosulfide/sodium sulfide; potassium sulfide/calcium oxide; potassium sulfide/sodium hydroxide; sodium sulfide/calcium oxide; sodium hyddrosulfide/calcium oxide; potassium hydrosulfide/sodium hydroxide; and potassium hydroxide/sodium hydrosulfide. The most preferred combinations include the following; potassium hydroxide/calcium oxide; potassium sulfide/-sodium sulfide; potassium hydrosulfide/sodium sulfide; potassium sulfide/calcium oxide; potassium hydrosulfide/sodium hydroxide; potassium hydroxide/sodium hydrosulfide; and potassium hydrosulfide/calcium oxide.

The total amount of these reagents which is employed in the process of the present invention is basically determined by the sulfur level of the particular feedstock which is being treated, as well as the degree of desulfurization desired, and the degree of hydroconversion desired. The total amount of reagent thus employed will generally vary from between about 0.1 wt. percent to 100 wt. percent, based on the feed, generally from about 0.1 to 50 wt. percent, and preferably from about 0.1 to 30 wt. percent, and most preferably from about 1 to 15 wt. percent. Again, however, this will depend upon the parameters discussed above.

The overall process of the present invention may be operated as a slurry of solids in intimate admixture with the oil feed, or where the mixture of hydrogenation reagents constitutes a low melting point eutectic, the process may be operated as a dispersion of the reagents in oil, i.e., where the reagents are molten at the reaction conditions employed. Where the reagents remain solid, operation is thus permitted as either a fixed or fluidized bed, and in those cases, the reagents may then be combined with a suitable support. Preferably, it becomes possible to utilize one of the components of the mixture as a support for the other in these cases. In particular, it is preferred that alkaline earth metal compounds be utilized as a support for alkali metal compounds.

Suitable supports which may be employed include coke, charcoal, alumina, silica, barium carbonate, barium sulfide, calcium oxide, calcium carbonate and the like, which provide a well dispersed supported reagent, in addition to other such suitable inert supports. These supported systems can be prepared by individually impregnating the support which is to be utilized with each reagent in sequence, or by coimpregnating this support with all of the individual reagents in a simultaneous manner. The amount of each reagent on a support is not critical, and may be varied considerably.

Where one of the reagents is utilized as a support for the other, this is preferably carried out by impregnating the one reagent with the other utilizing a suitable impregnating solvent, among which are included water, ammonia, or any organic solvent such as hydrocarbon, a halocarbon, alcohol, ketone, ester, or carboxylic acid, for example.

A hydrogen-containing gas is introduced into the contacting zone as either pure hydrogen (for example, from a steam reforming process) or as a diluted hydrogen gas stream (for example, that from refinery discard streams, e.g., subsequent to hydrotreating processes, gas effluent from cat crackers, or reformer light end streams, naptha reformer recycled hydrogen streams, and the like.)

While contact of the combination of at least two components including an alkali metal compound and an alkaline earth metal compound with the feedstock is carried out at reaction conditions generally designed to maintain the bulk of the feedstock, and preferably substantially all of the feedstock, in the liquid phase, such conditions may be varied to provide for vapor phase contact. Thus, the reaction of the feedstock and the hydrogenating reagent(s) can be carried out at a temperature within the range of from about 200° to 2000°

F., and under a hydrogen partial pressure greater than about 500 psig, and generally within the range of from about 500 to 5000 psig. The actual temperature and pressure conditions maintained within the reaction zone again will be varied depending upon the degree of desulfurization and/or hydroconversion which is desired, etc. Thus, generally where it is desired to obtain significant desulfurization along with substantial hydroconversion of the heavier constituents in the feedstock to lighter, lower boiling components, the reaction zone is maintained at a temperature within the range of from about 500° to about 1,500° F., and preferably within the range of from about 500° to 1000° F., more preferably from about 700° to 1,000° F., and under a hydrogen partial pressure of within the range of from about 500 to 3000 psig, preferably 500 to 2,500 psig. In addition, typical reaction holding times will generally range from about 15 minutes to about 300 minutes, preferably about 30 to 60 minutes. Furthermore, liquid hourly space velocities generally ranging from about 0.1 to 10, and preferably from about 0.1 to 5 may be employed.

This process can thus be conducted either as a batch or continuous type operation. Furthermore, the staged treating with fresh charges of reagent may also be employed if desired. Generally, the apparatus which is utilized in carrying out this process is conventional in nature, and can comprise either a single reactor or multiple reactors equipped with shed rows or other stationary devices to encourage contacting; efficient stirring devices such as mechanical agitators, jets of restricted internal diameter, turbomixers, and the like; or a packed bed, or other such means as described in U.S. Pat. No. 3,787,315, all of which is incorporated herein by reference thereto.

While not wishing to be bound by any particular theory with respect to the use of a mixture of at least two components including the alkali metal compounds and alkaline earth metal compounds, it is believed that one element critical to this activity is that one of the components so utilized be capable of reacting with sulfur or hydrogen sulfide. This component therefore acts as a sulfur sink, which binds with the sulfur released by the process feed during combined desulfurization and hydroconversion thereof, and therefore maintains the activity of the remaining component in a form suitable for performing the hydroconversion reaction itself. For this reason, the use of a mixture of components including one of the relatively active components listed above in combination with one of the relatively inactive components therein listed has been found to be of extreme utility in this invention.

Referring now specifically to the drawing, a sulfur-containing feedstock is preheated to about 400° to 700° F. and then fed through line 1, utilizing pump 2, and line 3, into separator 4. In separator 4, water and light gases are taken overhead through line 5. It is also preferred that the feed has been previously desalted by conventional means which are not shown in the drawing. The feed then exits the separator 4 through line 6 and is pumped by pump 7 through line 8 into filter 9 where scale and particulates are removed. The feed thus leaves the filter 9 through line 10 which then divides into two streams, namely lines 11 and 12. The portion fed into line 12 is fed through exchanger 13 and line 14 into mixing vessel 15 where a dispersion is formed with a combination of reagents entering from line 50. Mixing vessel 15 is preferably of a dispersator design, thus providing for high shear mixing therein. Preferably, temperatures of from 400° to 650° F. and pressures of from 50 to 500 psig are employed therein, along with holding times from 30 to 60 minutes. The salt-oil dispersion is then removed from the mixing vessel 15 through line 16 and is combined with the balance of the feed in line 11, whereupon this stream enters the charging pump 17 where the pressure is raised to about 1500 psig and the mixture then passes through line 18, heat exchanger 19, where a temperature rise to from about 750° to 850° F. is effected, and the mixture then enters reactor 22 through line 20. Hydrogen is fed into reactor 22 through line 21 in amounts such that the partial pressure of hydrogen in the reactor is from about 1500 to 2500 psig, and the reactor 22 is preferrably baffled to promote contacting between the combination of reagents and the oil as well as to prevent bypassing the inlet to the outlet. Holding time in the reactor generally ranges from 15 to 60 minutes, preferably about 30 minutes, and the temperature at the top of the reactor is about 850° F., but can range as high as about 900° F.

The combined metal salt and oil dispersion then leaves reactor 22 through line 23 and enters stripper tower 24 where the pressure is lowered to about 100 psig. Thus, light hydrocarbons, excess hydrogen, and hydrogen sulfide are removed overhead through line 25 and can be subsequently condensed, depressurized, and separated by conventional means not shown in the drawing. Hydrogen is then recycled to the reactor and light hydrocarbon products can be directed to storage or other usage. The hydrogen sulfide can be diverted to a Claus plant for sulfur recovery.

The oil-salt mixture is then removed from tower 24 through line 26 and pump 27 and through heat exchanger 28 where the temperature is adjusted to from 500° to 750° F. This stream then enters separator 30 through line 29 where the mixture then disengages readily into an upper desulfurized oil phase and a lower metal salt-coke phase. Separator 30 is thus preferably operated at from 500° to 750° F. and from 50 to 1000 psig, and the product oil is then removed through line 31 to heat exchanger 32 where the temperature is reduced to from 250° to 300° F. Acid, such as dilute sulfuric or acetic acid, can then be injected from line 34 into the product as it passes through line 33 in order to remove any residual inorganic salts therein. Electrostatic precipitator 36 then directs the product oil through line 35 to storage or downstream processing, while the aqueous phase is rejected through line 37 and can be discarded.

The combined metal salts including entrained coke and metals therein are removed from separator 30 through line 38 to be recycled to mixing vessel 15 through line 50. If desired, however, all or a portion of the salt stream may be directed to vessels 39 and 43 for the removal of coke, metals, and sulfur by various techniques. Thus, in the coke purge vessel 39, coke is removed through line 41 by slagging or skimming in the case where the salt blend provides a molten phase at the conditions at which vessel 39 is operated, i.e. normally from 150° to 750° F. and at a pressure of from 50 to 500 psig. The coke may also be separated from the salt solutions or from low melting solvates, either of which results from the addition of the proper quantity of water through line 40. Coke can also be separated from the liquid salt system by centrifugation, filtration, and other such conventional techniques not shown in the drawing. The salt blend is then transferred through line 42 into vessel 43 where metals and sulfur may be removed.

Metals may be removed by precipitation by properly adjusting the pH of the aqueous salt solution, the necessary water being added through line 45. Alternatively, the metals can be solvent extracted therein. Both of these techniques are quite conventional, and the metal sludge or extract can be removed through line 44 and directed to metals reclamation systems. Sulfur may be purged by steaming or by carbonation, i.e. high pressure steam or carbon dioxide is introduced through line 45 thereinto. The hydrogen sulfide thus exits overhead through line 46 and is directed to a Claus plant for recovery of elemental sulfur, and water may be stripped from the regenerated salt blend in vessel 43, thus also leaving through line 46. The conditions in vessel 43 may vary, generally from 200° to 700° F. and from 500 to 1000 psig, depending upon the particular operation being conducted therein. The salt blend enters dryer 48 through line 47 from vessel 43 to remove final traces of water therefrom, and is then directed through line 49 to line 50 for recycle to mixing vessel 15 as discussed hereinabove.

The various embodiments of the present invention may be more fully understood by reference to the following examples thereof.

EXAMPLES 1 THROUGH 11

The initial set of examples herein relates to the embodiment of this invention wherein a sulfur-containing feedstock is desulfurized in the presence of a hydrodesulfurization catalyst and is then subsequently contacted with alkali and/or alkaline earth metal compounds in order to produce feedstocks which are highly desirable as feedstocks for catalytic cracking processes.

A series of combined catalytic hydrodesulfurization and alkali-alkaline earth metal compound hydrotreating runs were carried out in accordance with this aspect of the present invention. Specifically, a Safaniya atmospheric residuum feedstock having the following inspections was subjected to catalytic hydrodesulfurization;

| Inspection of Feedstock | |
|---|---|
| Gravity, ° API | 14.5 |
| Sulfur, Wt. % | 3.93 |
| Carbon, Wt. % | 84.41 |
| Hydrogen, Wt. % | 11.13 |
| Nitrogen, Wt. % | 0.235 |
| Oxygen, Wt. % | 0.28 |
| Con. Carbon, Wt. % | 12.1 |
| MNI, Wt. % | 7.0 |
| Metals, ppm | |
| Nickel | 21 |
| Iron | 4 |
| Vanadium | 72 |
| Sodium | 4 |
| Flash Point, ° F. | 305 |
| Pour Point, ° F. | 35 |
| Viscosity at | |
| 122° F., SSF | 247.0 |
| 140° F., SSF | 129.9 |
| Distillation - ASTM | |
| IBP, ° F. | 458 |
| 5% at ° F. | 569 |
| 10% at ° F. | 633 |
| 20% at ° F. | 723 |
| 30% at ° F. | 801 |
| 40% at ° F. | 873 |
| 50% at ° F. | 958 |
| 60% at ° F. | 1047 |
| F.B.P. | 1047 |
| % Rec. | 60 |
| % Res. | 40 |
| **Hydrodesulfurization Catalyst Composition** | |
| CoO - Wt.% | 4.0 |
| $MoO_3$ Wt.% | 12.0 |
| $SiO_2$ Wt.% | 1.0 |
| $Al_2O_3$ Wt.% | 83.0 |
| **Hydrodesulfurization Catalyst** | |
| Surface Area | 300 $m^2$/gram |
| Pore Volume | 0.50 $cm^3$/gram |
| Pore Size | 90 volume % less than 100 angstroms |
| Bulk Density | 0.78 grams/ml. |
| **Hydrodesulfurization Conditions** | |
| Average Temperature | 725° F. |
| Hydrogen Pressure | 800 psig |
| Hydrogen Rate | 5000 scf/barrel |
| LHSV | 0.3 V/H/V |

This desulfurized feed was then subjected to a series of batch runs (1 hour each) in which it was contacted with the alkali and alkaline earth metal compounds thereof, including an initial control run (Example 1) in which no hydrotreating reagent was employed and a series of runs (Examples 2 through 11) in which various such reagents were utilized. The results obtained are shown in Table I attached hereto.

These results show that potassium hydroxide (Example 2), sodium hydroxide, (Example 3), sodium sulfide (Example 4), potassium sulfide (Example 5), and potassium hydroxide/calcium oxide (Example 11) each provide significant results with respect to coke reduction, suppressed gas yields, and the quality of the product obtained with respect to an increase in API gravity, metals content, etc. In addition, it is also demonstrated that by reducing the amount of reagent employed to 1% (Example 6) there was no significant reduction in the product yields and qualities obtained. In Example 7 it was also shown that while hydrogen pressure reduction to about 1,000 psig did not seriously affect the results obtained, the reduction to 500 psig, in Example 8, did result in excessive coke formation. Furthermore, by employing conditions which were comparable to those utilized in the initial catalytic hydrodesulfurization step, as in Examples 9, 10 and 11 comparable significant results were again obtained. In this instance a highly desirable commercial application is therefore demonstrated.

EXAMPLES 12 THROUGH 43

A second series of experiments were directed specifically to the embodiment of the present invention wherein at least two hydroconversion reagents were employed.

TABLE 1

HYDROTREATING A CATALYTICALLY DESULFURIZED FEEDSTOCK TO PRODUCE CAT-CRACKING FEEDS

| Example | | 1 | 2 | 3 | 4 | 5 | 6 | 7 | 8 | 9 | 10 | 11 |
|---|---|---|---|---|---|---|---|---|---|---|---|---|
| Reagent, | | — | KOH | NaOH | $Na_2S$ | $K_2S$ | KOH | KOH | KOH | KOH | $K_2S$ | KOH/CaO |
| Wt. % of Reagent on Feed | | — | 6 | 6 | 5 | 10 | 1 | 5 | 5 | 5 | 5 | 4 |
| Temp., ° F | | 820 | 820 | 820 | 820 | 820 | 820 | 820 | 820 | 750 | 750 | 700 |
| $H_2$, psig | | 1700 | 1700 | 1700 | 1700 | 1700 | 1700 | 1000 | 500 | 1500 | 1700 | 900 |
| $C_5$- Gas, Wt. % | | 10 | 1.4 | 1.1 | 1.4 | 2.7 | 1.0 | 1.0 | 1.2 | 0.3 | 2.2 | 0 |
| Coke, Wt. % | | 2.5 | 1.6 | 1.5 | 1.7 | 0.6 | 0.5 | 2.0 | 3.3 | 0.0 | 0.2 | 1.0 |
| Inspections | (Feed) | | | | | | | | | | | |
| Sulfur, Wt. % | 0.6 | 0.6 | 0.2 | 0.8 | 0.5 | 0.3 | 0.4 | 0.2 | 0.3 | 0.3 | 0.4 | 0.3 |

TABLE 1 -continued

HYDROTREATING A CATALYTICALLY DESULFURIZED FEEDSTOCK TO PRODUCE CAT-CRACKING FEEDS

| | | | | | | | | | | | | |
|---|---|---|---|---|---|---|---|---|---|---|---|---|
| Nitrogen, Wt. % | 0.3 | — | 0.2 | — | — | — | — | — | — | — | — | — |
| Con. Carbon, Wt. % | 7.8 | 4.1 | 3.7 | 6.0 | 7.7 | 4.9 | 5.7 | 4.2 | 4.8 | 5.4 | 6.1 | 4.6 |
| Ni/V/Fe, ppm | 10/43/1 | 2/3/1 | 1/0/1 | 6/0/3 | 4/11/0 | 3/0/0 | 7/2/0 | 1/0/5 | 0/0/0 | 5/1/0 | 9/4/2 | 1/0/0 |
| API Gravity | 18.3 | 30.3 | 26.3 | 28.8 | 28.5 | 26.4 | 27.0 | 27.7 | 28.7 | 18.8 | 19.1 | 19.0 |
| Asphaltenes, Wt. % | 5.8 | 5.9 | 1.9 | 4.8 | 5.3 | 2.6 | 3.8 | 0.7 | 2.2 | 3.0 | — | — |

EXAMPLE 12

As a control, in order to demonstrate the tendency of feedstocks to degrade under hydroconversion conditions, a 300 cc stirred autoclave was charged with 100 grams of a Safaniya atmospheric residuum having the inspections shown above in connection with examples 1-11.

The autoclave was pressurized with hydrogen to a pressure of about 1800 psig, and was heated and stirred at 825° F. for 30 minutes. Severe coking and cracking was observed, producing 5 weight percent $C_5^-$ Gas and 10 weight percent of coke therein. The necessity for applicant's active hydroconversion agents is therefore demonstrated.

The same 300 cc stirred autoclave was then charged with another 100 grams of the same Safaniya atmospheric residuum as well as with 6 grams of sodium. After pressurization to about 1900 psig with hydrogen, and stiring at 830° F. for 50 minutes, the following product inspections were obtained:

| | Inspections | Feed | Product |
|---|---|---|---|
| $C_5^-$ Gas, wt. % 2.2 | 2.0 Sulfur, wt.% | 3.9 | 0.2 |
| | Conradson carbon wt.% | 12.0 | 3.7 |
| Coke, wt.% | Ni/V/Fe,ppm | 101 | 2 |
| | API Gravity | 14.4 | 28.1 |

These results therefore show a desulfurization of 95%, a Conradson carbon conversion of 69%, and a demetallization of approximately 98%. These results can now be contrasted with the results obtained below with respect to the present invention.

EXAMPLES 13 THROUGH 28

A further series of experiments was then conducted according to the procedure shown in Example 12, but employing various other single reagents. The results obtained are shown in Table II below. It is specifically shown that certain of these reagents demonstrate

TABLE II

HYDROCONVERSION OF RESIDUUM WITH VARIOUS GROUP IA/IIA METAL COMPOUNDS

| Example | Reagent, Wt.% on Feed | $C_5$ - Gas Wt.% | Coke, Wt. % | API Gravity (60° F.) | Desulfurization % | Con Carbon Conversion,% | Demetallization % |
|---|---|---|---|---|---|---|---|
| 13 | KOH, 14 | 1.0 | 1.3 | 26 | 66 | 55 | 93 |
| 14 | $K_2S$, 14 | 1.6 | 1.9 | 27 | 64 | 54 | 91 |
| 15 | $Na_2O$, 20 | 2.1 | 2.5 | 26 | 86 | 56 | 95 |
| 16 | CaO, 19 | 5.6 | 9.8 | 30 | 23 | 46 | 88 |
| 17 | NaOH, 10 | 17.3 | 4.3 | — | 45 | 57 | 92 |
| 18 | $Na_2S$, 9 | 4.6 | 5.3 | 27 | 38 | 36 | 78 |
| 19 | NaSH, 10 | 5.3 | 4.1 | 22 | 25 | 32 | 57 |
| 20 | KSH, 18 | 6.2 | 7.5 | 29 | 42 | 44 | 88 |
| 21 | $Na_2CO_3$, 12 | 11.6 | 9.0 | 31 | 43 | 44 | 93 |
| 22 | $K_2CO_3$, 18 | 13.3 | 8.1 | 30 | 43 | 44 | 97 |
| 23 | BaO, 19 | 3.0 | 1.4 | 26 | 44 | 40 | 89 |
| 24 | CaS, 11 | 4.2 | 9.5 | 30 | 35 | 48 | 86 |
| 25 | CsOH, 14 | 1.9 | 0.8 | 24 | 52 | 47 | 84 |
| 26 | $Cs_2S$, 33 | 3.4 | 1.8 | 27 | 53 | 44 | 87 |
| 27 | CsSH, 19 | 2.5 | 3.2 | 29 | 35 | 42 | 80 |
| 28 | $Cs_2CO_3$, 16 | 3.3 | 2.3 | 27 | 45 | 44 | 86 |

rather poor results, such as those shown in Example 16 through 24, including high coke and gas yields, poor to modest product quality improvement, and both in some cases.

EXAMPLES 29 THROUGH 35

In a subsequent series of experiments, a combination of sodium hydroxide and calcium oxide was employed, again utilizing the conditions as shown in Examples 13 through 28.

The results obtained are shown in Table III below. The results in Examples 29 and 30 may thus be compared with the results in Examples 31 through 35. The excellent activity of the mixture as opposed to the poor activity of each of the individual components is therefore demonstrated, thus supporting the synergism obtained in accordance with this invention. Examples 31 through 35 also illustrate that the reagent combination appears to be relatively insensitive to the relative weight ratios of the two components utilized and to the size of the reagent charge.

EXAMPLES 36 THROUGH 44

In a further series of experiments, a combination of potassium hydroxide and calcium oxide was employed, again utilizing the conditions as shown in Examples 13 through 28. The results obtained in this series of experiments are contained in Table IV below. These results demonstrate that the admixture of potassium hydroxide in small amounts with calcium oxide provides good hydroconversion activity. Thus, by comparing examples 38, 40 and 44, it can be seen that at a constant ratio of potassium hydroxide to calcium oxide the total reagent charge had a profound effect on the efficiency of the hydroconversion reaction obtained. These data also illustrates the effect of increasing the concentration of a good sulfur acceptor, namely the calcium oxide therein. Examples 43 and 44 also show that potassium

TABLE III

HYDROCONVERSION OF RESIDUUM WITH SODIUM HYDROXIDE/CALCIUM OXIDE

| Example | Reagent, Wt.% on Feed | $C_5$- Gas Wt.% | Coke Wt.% | API Gravity | Desulfurization, % | Con. Carbon Conversion, % | Demetallization, % |
|---|---|---|---|---|---|---|---|
| 29 | CaO, 19 | 5.6 | 9.8 | 30 | 23 | 46 | 88 |
| 30 | NaOH, 10 | 17.3 | 4.3 | — | 45 | 57 | 92 |
| 31 | NaOH, 10 CaO, 10 | 2.2 | 1.6 | 23 | 41 | 40 | 86 |
| 32 | NaOH, 5 CaO, 5 | 2.6 | 2.2 | 23 | 28 | 40 | 70 |
| 33 | NaOH, 1 CaO, 5 | 2.6 | 2.6 | 24 | 34 | 47 | 86 |
| 34 | NaOH, 10 CaO, 5 | 2.1 | 2.6 | 23 | 34 | 40 | 82 |
| 35 | NaOH, 5 CaO, 25 | 2.1 | 1.0 | 23 | 41 | 37 | 74 |

TABLE IV

HYDROCONVERSION OF RESIDUUM WITH POTASSIUM HYDROXIDE/CALCIUM OXIDE

| Example | Reagent, Wt.% on Feed | $C_5$ - Gas Wt.% | Coke Wt.% | API Gravity | Desulfurization % | Con. Carbon Conversion,% | Demetallization % |
|---|---|---|---|---|---|---|---|
| 36 | KOH, 14 | 1.0 | 1.3 | 26 | 66 | 55 | 93 |
| 37 | CaO, 19 | 5.6 | 9.8 | 30 | 23 | 46 | 88 |
| 38 | KOH, 1 CaO, 5 | 2.7 | 3.0 | 21 | 35 | 40 | 89 |
| 39 | KOH, 5 CaO, 5 | 1.7 | 0.7 | 22 | 49 | 42 | 86 |
| 40 | KOH, 2 CaO, 10 | 1.1 | 0.2 | 23 | 60 | 60 | 82 |
| 41 | KOH, 1 CaO, 25 | 1.1 | 1.1 | 24 | 61 | 59 | 89 |
| 42 | KOH, 2.5 CaO, 20 | 1.4 | 2.4 | 24 | 81 | 74 | 95 |
| 43 | KOH, 5 CaO, 20 | 1.5 | 3.5 | 27 | 91 | 80 | 94 |
| 44 | KOH, 5 CaO, 25 | 2.3 | 3.6 | 28 | 89 | 83 | 96 |

hydroxide/calcium oxide, at these loading levels, is a powerful hydroconversion system comparable in activity to the very reactive reagent, sodium metal (see Example 12), for conradson carbon conversion.

EXAMPLES 45 THROUGH 49

In a subsequent series of experiments, the combination of potassium hydroxide and calcium oxide was again tested, but this time in conjunction with a variety of different feedstocks, again utilizing the conditions as shown in Examples 13 through 28. The versatility of this reagent combination is clearly demonstrated therein. The results obtained are contained in Table V below.

EXAMPLES 50 THROUGH 83

In another series of experiments, various different combinations of reagents within the scope of the present invention were employed, again utilizing the conditions as shown in Examples 13 through 28. The results obtained are contained in Table VI below.

These results demonstrate the scope of the present invention, since in each case the hydroconversion activity of the combined reagents did exceed that of the individual components. Specifically, Examples 51, 52, 59, 62, 63, 66 and 77 are particularly striking with regard to the synergistic combination of components of this invention.

TABLE V

HYDROCONVERSION WITH KOH/CaO (5/25 WT. % ON FEED)

| Example | 45 | | 46 | | 47 | | 48 | | 49 | |
|---|---|---|---|---|---|---|---|---|---|---|
| Feed | Jobo Crude | | Shale Oil | | Safaniya Vacuum Residuum | | Athabasca Bitumen | | Cold Lake Crude | |
| $C_5$ - Gas, Wt. % | 1.9 | | 1.0 | | 2.1 | | 2.2 | | 2.3 | |
| Coke, Wt. % | 3.6 | | 0.4 | | 6.9 | | 1.0 | | 4.3 | |
| Inspections | Feed | Product | Feed | Product | Feed | Product | Feed | Product | Feed | Product |
| Sulfur, Wt. % | 3.8 | 0.5 | 0.8 | 0.2 | 5.2 | 0.5 | 4.5 | 0.5 | 4.2 | 0.4 |
| Con. Carbon, Wt. % | 13.8 | 3.5 | 4.5 | 0.4 | 23.7 | 5.7 | 12.3 | 2.5 | 11.0 | 2.8 |
| Ni/V/Fe, ppm | 97/459/- | 0/3/0 | 3/1/- | 0/1/1 | 53/171/28 | 1/0/0 | 78/148/416 | 0/0/0 | 59/173/12 | 1/0/8 |
| API Gravity | 8.5 | 24 | 19.9 | 30 | 4.6 | 23 | 10.3 | 25 | 10.4 | 25 |
| Desulfurization, % | 87 | | 75 | | 90 | | 89 | | 91 | |
| Con. Carbon Conv., % | 75 | | 91 | | 76 | | 80 | | 75 | |
| Demetallization, % | 100 | | 50 | | 100 | | 100 | | 96 | |

TABLE VI

HYDROCONVERSION WITH VARIOUS GROUP IA/IIA COMPOUNDS

| Example | Reagent,Wt.% on Feed | $C_5$ - Gas Wt.% | Coke Wt.% | API Gravity | Desulfurization % | Con. Carbon Conv., % | Demetallization % |
|---|---|---|---|---|---|---|---|
| 50 | Na, 3 CaO, 10 | 1.8 | 0.6 | 23 | 50 | 39 | 80 |
| 51 | $Na_2CO_3$, 5 CaO, 10 | 2.4 | 4.8 | 26 | 24 | 36 | 86 |

TABLE VI-continued

| HYDROCONVERSION WITH VARIOUS GROUP IA/IIA COMPOUNDS | | | | | | | |
|---|---|---|---|---|---|---|---|
| Example | Reagent, Wt.% on Feed | $C_5$ - Gas Wt.% | Coke Wt.% | API Gravity | Desulfurization % | Con. Carbon Conv., % | Demetallization % |
| 52 | $K_2CO_3$, 10<br>CaO, 25 | 2.0 | 2.1 | 23 | 52 | 49 | 88 |
| 53 | NaOH, 2.5<br>KOH, 2.5<br>CaO, 25 | 2.1 | 3.7 | 27 | 81 | 77 | 92 |
| 54 | RbOH, 9<br>CaO, 25 | 2.3 | — | 28 | 94 | 88 | — |
| 55 | KOH, 5<br>BaO, 35 | 1.6 | — | 23 | 60 | 50 | 73 |
| 56 | KOH, 5<br>$Ca(OH)_2$, 25 | 1.4 | 0.4 | 20 | 35 | 35 | 65 |
| 57 | $K_2S$, 13<br>$Na_2S$, 9 | 1.6 | 1.9 | 26 | 64 | 59 | 90 |
| 58 | KOH, 5<br>$Na_2S$, 25 | 1.8 | 1.6 | 25 | 47 | 44 | 88 |
| 59 | KSH, 5<br>CaO, 25 | 2.7 | 1.8 | 25 | 58 | 58 | 85 |
| 60 | CsOH, 5<br>$Na_2S$, 25 | 2.1 | 2.3 | 26 | 55 | 52 | 87 |
| 61 | KSH, 5<br>$Na_2S$, 25 | 3.1 | 3.4 | 26 | 38 | 45 | 85 |
| 62 | KOH, 5<br>$Na_2S$, 15 | 2.3 | 2.7 | 25 | 46 | 44 | 90 |
| 63 | KOH, 1<br>$Na_2S$, 25 | 1.8 | 2.9 | 26 | 36 | 36 | 87 |
| 64 | $KOCH_3$, 5<br>CaO, 25 | — | 1.4 | 25 | 70 | 64 | 97 |
| 65 | $K_2S$, 5<br>$Na_2S$, 25 | 1.6 | 1.9 | 25 | 46 | 40 | 79 |
| 66 | $K_2S$, 5<br>CaO, 25 | 2.5 | 3.1 | 27 | 90 | 85 | 100 |
| 67 | $K_2S$, 5<br>NaOH, 20 | 2.7 | 1.5 | — | 61 | 53 | 81 |
| 68 | KOH, 3<br>NaOH, 15 | 2.9 | 2.7 | 23 | 50 | 48 | 89 |
| 69 | $K_2S$, 5<br>CaS, 25 | 3.0 | 3.1 | 28 | 34 | 41 | 82 |
| 70 | $K_2S$, 5<br>$Ca(OH)_2$, 25 | — | 1.1 | — | 53 | 47 | 87 |
| 71 | $Cs_2S$, 5<br>$Na_2S$, 25 | 3.1 | 3.2 | 29 | 39 | — | 85 |
| 72 | $Cs_2S$, 5<br>CaO, 25 | 3.0 | 2.5 | 29 | 76 | 81 | 90 |
| 73 | $Cs_2S$, 5<br>CaS, 25 | 3.1 | 4.4 | 28 | 31 | 39 | 79 |
| 74 | $Cs_2S$, 5<br>$Ca(OH)_2$, 25 | 2.4 | 1.4 | 25 | 59 | 58 | 84 |
| 75 | $Cs_2S$, 5<br>$CaCO_3$, 25 | 3.1 | 2.1 | 23 | 37 | 46 | 82 |
| 76 | $K_2S$, 5<br>$CaCO_3$, 25 | 2.3 | 2.2 | 21 | — | 37 | 74 |
| 77 | CaO, 7<br>$Na_2S$, 7 | 2.7 | 1.3 | 23 | 41 | 44 | 69 |
| 78 | CaO, 7<br>NaSH, 7 | 2.3 | 1.0 | 23 | 39 | 37 | 68 |
| 79 | CaS, 8<br>$Na_2O$, 6 | 1.9 | 1.1 | 25 | 46 | 43 | 80 |
| 80 | NaOH, 5<br>$Na_2S$, 10 | 2.9 | 4.6 | 27 | 37 | 36 | 90 |
| 81 | KSH, 9<br>NaOH, 5 | 3.1 | 2.8 | 24 | 45 | 39 | 79 |
| 82 | KOH, 7<br>NaSH, 7 | 3.1 | 3.0 | 24 | 41 | 34 | 77 |
| 83 | KSH, 9<br>$Na_2S$, 9 | 1.5 | 2.9 | 25 | 40 | 36 | 80 |

EXAMPLES 84 THROUGH 94

In a series of experiments, cesium compounds were compared as reagents with other alkali metal compounds. The feedstock utilized was a Safaniya atmospheric residuum having the characteristics shown in Table VII. The experiments were conducted for one hour at 820° F. and a hydrogen partial pressure of 1800 psig. The results of these experiments are shown in Table VIII.

As can be seen from the data of Table VIII, Examples 84 to 86 show that cesium hydrosulfide possesses hydroconversion activity for the simultaneous desulfurization, demetallization and conversion of Conradson carbon. Sodium and potassium hydrosulfide give lower liquid yield.

Examples 87 to 89 compare the activity of cesium carbonate with the activity of sodium and potassium carbonate. Cesium carbonate gave a better yield of improved product.

Example 90 shows the hydroconversion activity of cesium sulfide.

Example 91 shows the use of calcium oxide as sulfur acceptor in combination with cesium sulfide.

Example 92 shows that the substitution of a material incapable of binding sulfur instead of the use of calcium oxide gives results similiar to those of treating the feed with cesium hydrosulfide alone as in Example 86.

Example 93 shows the use of calcium hydroxide as a promoter for cesium sulfide hydroconversion. The combination is superior to cesium sulfide alone.

Example 94 shows that calcium carbonate with cesium sulfide is not as effective as calcium oxide or calcium hydroxide.

TABLE VII

| FEEDSTOCK INSPECTIONS | |
|---|---|
| API Gravity | 14.4 |
| Sulfur, wt. % | 3.91 |
| Nitrogen, wt. % | 0.26 |
| Carbon, wt. % | 84.42 |
| Hydrogen, wt. % | 11.14 |
| Oxygen, wt. % | 0.27 |
| Conradson carbon, wt. % | 12.1 |
| Asphaltenes, wt. % | 17 |
| Ni, ppm | 20 |
| V, ppm | 77 |
| Fe, ppm | 4 |
| Viscosity, 122° F. | 235 |
| Pour point, ° F. | 33 |
| 1050° F.−, vol. % | 59.2 |
| 1050° F.+, vol. % | 40.8 |

TABLE VIII

| Ex. No. Reagent (wt % on oil) | 84 NaSH (10) | 85 KSH (9) | 86 CsSH (18) | 87 $Na_2CO_3$ (12) | 88 $K_2CO_3$ (18) | 89 $Cs_2CO_3$ (16) | 90 $Cs_2S$ (33) | 91 $Cs_2S$(5) CaO(27) | 92 $Cs_2S$(5) CaS(27) | 93 $Cs_2S$(5) $Ca(OH)_2$(27) | 94 $Cs_2S$(5) $CaCO_3$(27) |
|---|---|---|---|---|---|---|---|---|---|---|---|
| $C_3^-$ gas, wt % | 5.4 | 6.2 | 2.5 | 11.6 | 13.3 | 3.3 | 3.4 | 3.0 | 3.1 | 2.4 | 3.1 |
| Coke, wt % | 4.1 | 8.3 | 3.2 | 9.0 | 8.1 | 2.3 | 1.8 | 4.4 | 4.4 | 1.4 | 2.1 |
| $C_5^+$ liquid, wt % | 90.5 | 85.5 | 94.3 | 79.4 | 78.6 | 94.4 | 94.8 | 92.6 | 92.5 | 95.2 | 94.8 |
| API gravity | 22.3 | 29.1 | 29.1 | 31.0 | 30.0 | 26.7 | 26.8 | 29.2 | 27.9 | — | — |
| Desulfurization, % | 25 | 40 | 35 | 43 | 43 | 45 | 53 | 76 | 31 | 59 | 37 |
| Demetallization, % | 57 | 90 | 80 | 93 | 97 | 86 | 87 | 90 | 79 | 87 | 82 |
| Con. carbon less, % | 24 | 44 | 42 | 44 | 44 | 44 | 44 | 81 | 39 | 58 | 46 |

What is claimed is:

1. A process for hydrotreating a partially desulfurized petroleum oil feedstock in a reaction zone at a temperature ranging from about 500° to about 1500° F. in the presence of sufficient added hydrogen to produce a hydrogen partial pressure of from about 500 to 5000 psi, which comprises: contacting said feedstock in said reaction zone with a reagent consisting essentially of a compound selected from the group consisting of (a) at least one alkali metal compound selected from the group consisting of alkali metal oxides, alkali metal sulfides, alkali metal hydrosulfides, alkali metal amides, alkali metal carbonates, alkali metal carboxylates, and alkali metal alkoxides; (b) at least one compound selected from the group consisting of alkaline earth metal hydroxides, alkaline earth metal sulfides, alkaline earth metal hydrosulfides, alkaline earth metal amides, alkaline earth metal carbonates, alkaline earth metal alkoxides, and (c) a mixture of at least one alkali metal compound and at least one alkaline earth metal compound, said alkali metal compound being selected from the group consisting of alkali metal oxides, alkali metal hydroxides, alkali metal sulfides, alkali metal hydrosulfides, alkali metal amides, alkali metal carbonates, alkali metal carboxylates, alkali metal alkoxides and, wherein said alkaline earth metal compound is selected from the group consisting of alkaline earth metal oxides, alkaline earth metal hydroxides, alkaline earth metal sulfides, alkaline earth metal hydrosulfides, alkaline earth metal carboxylates and alkaline earth metal alkoxides.

2. The process of claim 1 wherein the alkali metal constituent of said alkali metal compound is selected from the group consisting of sodium, potassium and cesium.

3. The process of claim 1 wherein the alkaline earth metal constituent of said alkaline earth metal compound is selected from the group consisting of calcium, barium and magnesium.

4. The process of claim 1 wherein said alkaline earth metal compound is an alkaline earth oxide.

5. The process of claim 1 wherein said reagent is a mixture of at least one alkali metal compound and at least one alkaline earth metal compound of group (c).

6. The process of claim 1 wherein said reagent is present in said reaction zone in an amount ranging from about 1 to about 15 weight percent.

7. The process of claim 1 wherein prior to said hydrotreating stage, a sulfur-containing pertroleum oil is subjected to catalytic desulfurization in a reaction zone maintained at a temperature ranging from about 500° to about 2000° F. in the presence of a sufficient amount of added hydrogen to provide a hydrogen pressure ranging from about 500 to about 2500 psi and thereby produce said partially desulfurized feedstock which is subsequently hydrotreated.

* * * * *